United States Patent [19]

Bayer

[11] Patent Number: 4,608,802

[45] Date of Patent: Sep. 2, 1986

[54] CONNECTOR FOR USE IN SPACERS FOR MULTIPLE-PANE WINDOWS

[75] Inventor: Franz Bayer, Elzach, Fed. Rep. of Germany

[73] Assignee: Franz Xaver Bayer Isolierglasfabrik KG, Elzach, Fed. Rep. of Germany

[21] Appl. No.: 635,442

[22] Filed: Jul. 30, 1984

[30] Foreign Application Priority Data

Jul. 29, 1983 [DE] Fed. Rep. of Germany ..... 3327366

[51] Int. Cl.[4] ..... E06B 3/66

[52] U.S. Cl. ..... 52/788; 52/401; 52/402; 52/726

[58] Field of Search ..... 52/171, 172, 656, 788, 52/304, 288, 395, 397, 402, 403, 726; 403/231, 401, 295, 402, 403; 428/34

[56] References Cited

U.S. PATENT DOCUMENTS

| | | | |
|---|---|---|---|
| 3,728,833 | 4/1973 | Grossman | 52/288 X |
| 4,097,320 | 6/1978 | Brauer et al. | 52/788 X |
| 4,145,150 | 3/1979 | Rafeld | 52/656 X |
| 4,261,145 | 4/1981 | Bröcking | 52/172 |
| 4,453,855 | 6/1984 | Richter et al. | 52/656 X |
| 4,500,572 | 2/1985 | Francis | 52/172 X |
| 4,513,546 | 4/1985 | Gow | 52/172 |

FOREIGN PATENT DOCUMENTS

| | | |
|---|---|---|
| 0110295 | 11/1983 | European Pat. Off. . |
| 1575215 | 2/1970 | Fed. Rep. of Germany . |
| G7438128.5 | 1/1976 | Fed. Rep. of Germany . |
| 2545209 | 4/1977 | Fed. Rep. of Germany . |
| 2831838 | 2/1979 | Fed. Rep. of Germany . |
| 2809822 | 9/1979 | Fed. Rep. of Germany . |
| 2829444 | 1/1980 | Fed. Rep. of Germany . |
| 2938481 | 8/1980 | Fed. Rep. of Germany . |

*Primary Examiner*—J. Karl Bell

*Attorney, Agent, or Firm*—Peter K. Kontler

[57] ABSTRACT

A spacer for use between the panes of a multiple-pane window has two tubular components whose end faces are spaced apart from one another by two relatively small teeth of an elongated plug one half of which extends into one tubular component and the other half of which extends into the other tubular component. The plug has recesses which receive portions of the respective tubular components to hold the plug against extraction from the tubular components as well as to urge some of an adhesive sealing compound at the exterior of each half of the plug toward and into the gap between the two end faces. Such gap is only partially filled by the teeth and receives sealing compound from a depression in the external surface of the plug in response to deformation of adjacent end portions of the tubular components so that the gap is filled or practically filled with sealing compound in automatic response to proper attachment of the plug to the two tubular components.

30 Claims, 3 Drawing Figures

CONNECTOR FOR USE IN SPACERS FOR MULTIPLE-PANE WINDOWS

BACKGROUND OF THE INVENTION

The present invention relates to improvements in spacers for use in multiple-pane windows, and more particularly to improvements in so-called connectors or plugs which serve to couple the neighboring ends of tubular components of such spacers to each other.

It is well known to assemble the spacer or spacers of a multiple-pane window from a single length or from several lengths of a tubular stock whose end portions are placed substantially end to end and are coupled to each other by plugs extending into the interior of such end portions. Reference may be had, for example, to FIGS. 8 and 9 of U.S. Pat. No. 4,261,145 to Bröcking which discloses a method of making tubular spacers as well as one type of a plug which can connect two neighboring end portions of a tubular spacer to each other. As a rule, one also resorts to a sealing compound in order to prevent the penetration of atmospheric air into the space which is surrounded by the assembled spacer and is disposed between the neigbhoring window panes. Moreover, the spacer normally contains a suitable desiccant to absorb moisture and to thus prevent premature fogging of the inner sides of the window panes. The plug of the patented sealer has a circumferentially complete rib fitting between the end faces of the end portions which are being joined by the plug, and the dimensions of the circumferentially complete rib are selected in such a way that its peripheral surface is flush with the external surfaces of the adjacent tubular components. This is supposed to ensure predictable contact between the rib and the entire end faces of the corresponding tubular components of the spacer.

A drawback of the patented sealer is that reliable sealing of the butt joint between the neighboring tubular components presents many problems. As a rule, the sealing compound is a rather tough mass of very high viscosity which cannot be readily forced into narrow clearances between the rib and the adjacent end faces of the tubular components. Therefore, the narrow clearances cannot be properly sealed and they invariably establish paths for the inflow of moist atmospheric air which shortens the useful life of the product. Manufacturing tolerances also contribute to the lack of adequate sealing and to premature fogging of the inner sides of the adjacent window panes.

Attempts to overcome the just discussed problems in connection with adequate sealing of joints between the tubular components of the spacer include the making of a spacer which is inwardly adjacent to the edge faces of the adjacent panes, i.e., which is somewhat smaller than the panes so as to provide therearound a circumferentially complete groove for the introduction of a sealing compound all the way around the spacer. Such proposal reduces the likelihood of premature fogging of the panes but does not constitute a highly satisfactory solution for several reasons. First of all, the joint between the end faces of two neighboring tubular components of the spacer remains unsealed and, secondly, the utilization of a relatively small spacer reduces the effective dimensions of the multiple-pane window. Therefore, such solution can be resorted to only when the groove into which the marginal portions of a multiple-pane window are to be fitted is sufficiently deep to conceal the spacer and the sealing compound therearound.

Another drawback of presently known spacers, and especially of the plugs which are used to join pairs of tubular components of such spacers, is that they cannot meet certain other requirements which are expected from an efficient plug. Thus, the plugs must contribute significantly to the stability of the spacer, they must prevent angular displacements of the coupled-together tubular components relative to each other, and they must offer a pronounced resistance to bending and/or other deformation of the joints. Moreover, unavoidable machining or manufacturing tolerances should not adversely affect the tightness and/or appearance of the joints.

OBJECTS AND SUMMARY OF THE INVENTION

An object of the invention is to provide a novel and improved spacer for use in multiple-pane windows or the like.

Another object of the invention is to provide a novel and improved connector for the tubular components of a spacer.

A further object of the invention is to provide a novel and improved method of assembling the connector with the respective tubular components of the spacer.

An additional object of the invention is to provide a connector which is capable of standing pronounced torsional and/or other deforming stresses, which allows for highly satisfactory sealing of the joint between the interconnected tubular components of the spacer, and which can be mass-produced in a wide variety of sizes and/or shapes.

Still another object of the invention is to provide a connector which can be stored with identical or similar connectors in a small area and for any desired period of time, which can be assembled with the tubular components of a spacer by hand or in automatic or semiautomatic machines, and which can be permanently connected with the respective tubular components in a novel and improved way.

Another object of the invention is to provide a connector which is constructed and configurated in such a way that, when properly assembled with the corresponding tubular components of the spacer, it automatically enhances or ensures airtight sealing of the joint between the end portions of the tubular components.

An additional object of the invention is to provide a connector which ensures adequate airtight sealing of the joint between two tubular components of the spacer so that the latter need not be surrounded by a mass of sealing compound and can extend all the way to the edge faces of the neighboring panes.

One feature of the invention resides in the provision of a spacer for the panes of a multiple-pane window. The improved spacer comprises first and second deformable tubular components having adjacent end faces which define a gap, and an elongated connector including or constituting a plug having first and second sections disposed in the interior of the respective tubular components and a composite abutment which is disposed between the end faces of the tubular components and only partially fills the gap. Each section of the connector or plug has at least one recess, and the respective tubular component has a depressed wall portion extending into the corresponding recess to hold the section against axial movement relative to (particularly against extraction from) the respective tubular component and/or vice versa. The spacer further comprises a mass of sealing compound which fills at least a portion of the remainder of the gap.

The abutment can constitute a protuberance which is at least partially recessed into the end faces of the two deformable tubular components. The outer side of the connector can be provided with two longitudinally extending lateral facets, and the abutment can comprise two portions in the form of teeth or the like each of which extends from a different one of the two facets. Since the facets form part of the external surface of the connector, the portions of the abutment extend outwardly beyond and preferably taper in directions away from such external surface. Each portion of the abutment can have a preferably flat top land which is remote from the respective facet, i.e., from the external surface of the connector.

The spacer preferably further comprises two discrete layers or a coherent layer of adhesive sealing compound interposed between the two sections of the connector and the internal surfaces of the respective tubular components. Such sealing compound can consist of or can contain butyl rubber. The abutment is preferably located at least substantially midway between the two ends of the connector, and the aforementioned layers of sealing compound are adjacent to and can overlie the portions of the abutment.

The connector can be formed with a depression between the two portions of the abutment and with a preferably elongated rib-like distancing element which is disposed close to or in the central region of the depression. The top face of the distancing element is preferably located inwardly of the adjacent portion of the external surface of the connector, and the two tubular components preferably include depressed end portions which abut against the preferably flat top face of the distancing element to thereby expel a certain amount of sealing compound from the depression toward and into the gap between the two tubular components. The depth of the depression can be approximately twice the height of the distancing element. One half of the distancing element is received in one tubular component, and the other half of the distancing element is received in the other tubular component. Such distancing element is preferably disposed midway between the two portions of the abutment.

Each of the aforementioned recesses in the sections of the connector is preferably bounded in part by an end surface which slopes inwardly from the external surface of the connector and toward the portions of the abutment. Each recess preferably widens in a direction toward the abutment, and the depth of each recess preferably increases in the opposite direction. Each section of the connector can be provided with two recesses; however, it is equally within the purview of the invention to provide each section of the connector with a single recess or with three or even more recesses. The layers of sealing compound can overlie the surfaces bounding the recesses in the connector, for example, the surfaces bounding the two recesses which are nearest to the abutment.

That (inner) side of the connector which faces away from the aforementioned facets can be provided with one or more cutouts or cavities to reduce the overall weight of the connector as well as to serve (if necessary) as additional or sole recesses for reception of portions of the adjacent walls of the corresponding tubular components. The recesses can be provided in the outer side of the connector (i.e., in that side which is nearest to the adjacent edge faces of the window panes), in the inner side of the connector, in the aforementioned facets, or in the side surfaces of the connector. The end portions of the connector are preferably rounded or otherwise configurated with a view to facilitate their introduction into the respective tubular components.

Another feature of the invention resides in the provision of a connector of the above outlined character in combination with a sheet or foil of protective flexible material overlying the aforementioned layer or layers of adhesive sealing compound to prevent adherence of the connector to a neighboring connector(s) or other objects. The sheet is detached prior to introduction of the two sections of the connector into the respective tubular components. Such sheet ensures that the distribution of adhesive sealing compound on the connector remains undisturbed and is best suited for proper bonding of the connector to the tubular components as well as for proper filling of the gap with sealing compound The sheet can be large enough to overlie the layers of sealing compound on two or more neighboring connectors, e.g., on an entire battery of parallel connectors.

The novel features which are considered as characteristic of the invention are set forth in particular in the appended claims. The improved spacer itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
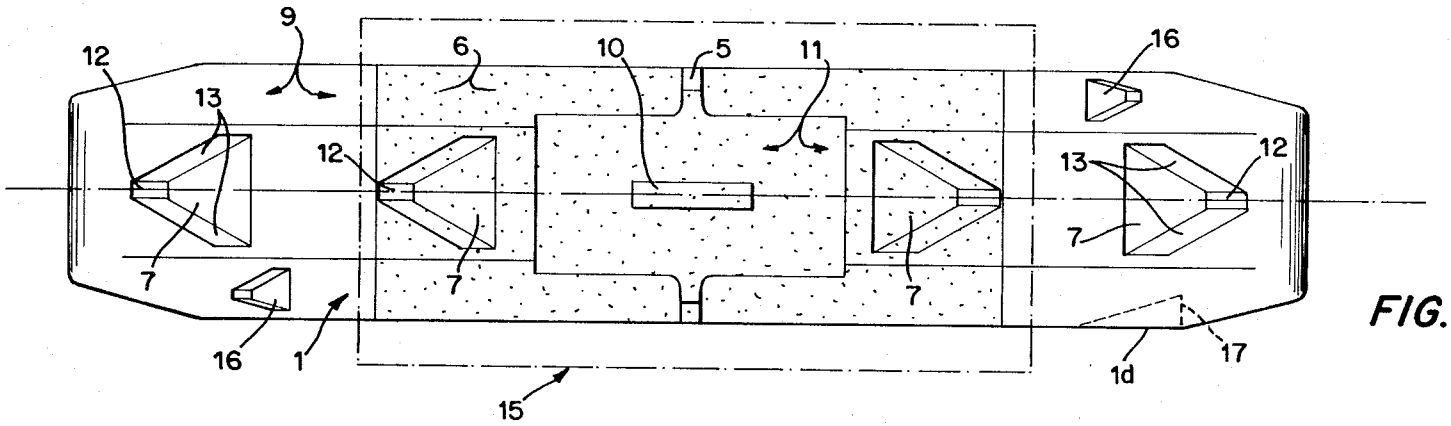
FIG. 1 is an enlarged plan view of a connector which embodies one form of the invention.
Figure 3:
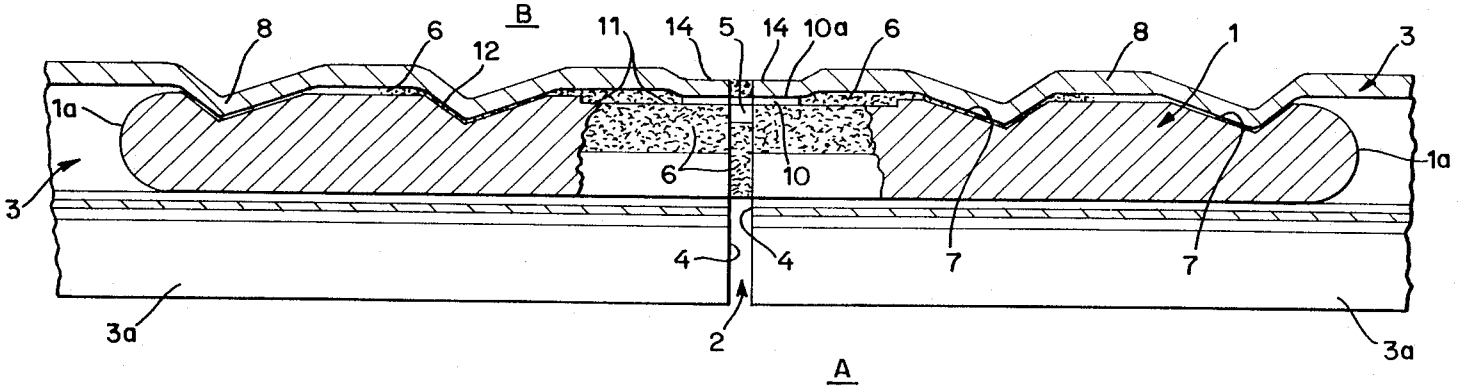
FIG. 3 is a fragmentary longitudinal sectional view of a spacer which includes the connector of FIG. 1 and two tubular components which receive the respective sections of the connector.

The connector 1 which is shown in FIG. 1 is an elongated plug made of a metallic (as shown) or plastic material. This connector is assembled with two coaxial tubular components 3 (see FIG. 3) forming part of a circumferentially complete spacer between two window panes (now shown). The components 3 are mirror symmetrical to one another and each thereof receives a section (preferably one-half) of the connector 1. The end faces 4 of the tubular components 3 define a narrow gap 2 which must be sealed for several reasons, namely to prevent escape of desiccant which is confined in the components 3 inwardly of the respective sections of the connector 1 and also to prevent the penetration of air into the (normally evacuated) space A within the confines of the spacer and between the neighboring panes of the multiple-pane window. With reference to FIG. 3, one of the panes is located in front and the other pane is located behind the plane of the drawing. The reference characters 3*a* denote extensions or skirts forming part of the tubular components 3 and extending inwardly, i.e., away from the edge faces of the respective panes. Reference may be had, for example, to FIG. 7 of the commonly owned copending patent application Ser. No. 598,444 filed Apr. 9, 1984 by Franz Bayer et al. for "Method of and apparatus for making spacers for use in multiple-pane windows or the like" where the extensions of one of the tubular components of the spacer are denoted by the characters 29. Each component 3 has two spaced-apart extensions 3*a*, each inwardly adjacent to a different one of the respective panes.

Figure 2:
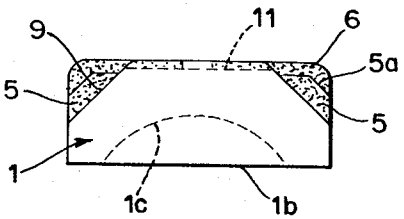
FIG. 2 is an end elevational view of the connector which in FIG. 1.

The dimensions of the two sections of the connector 1 are preferably selected in such a way that they can be inserted, with a small amount of play, into the respective tubular components 3. The means for limiting the extent of insertion of the sections of the connector 1 into the respective components 3 comprises a composite abutment in the form of a two-piece protuberance having two mirror symmetrical portions 5 disposed exactly or substantially midway between the rounded end portions 1*a* of the connector. The portions 5 of the protuberance cannot fit into the adjacent end portions of the tubular components 3 so that they remain in the gap 2 and thus ensure the provision of room for a certain amount of sealing compound 6 which is used to establish an airtight seal between the space A of the assembled spacer and the surrounding area or space B. The dimensions of the two portions 5 of the protuberance on the connector 1 are selected in such a way that the portions 5 do not extend outwardly beyond the external surfaces of the adjacent portions of the tubular components 3, i.e., that the entire protuberance is confined in and fills only a portion of the gap 2. This can be readily seen in FIG. 2 which shows that the portions 5 of the protuberance on the median portion of the connector 1 do not extend beyond the outline of the major part of the connector. The latter is preferably provided with two suitably inclined longitudinally extending lateral facets 9 which form part of the external surface of the connector 1, and the portions 5 of the protuberance (these portions will be called teeth for the sake of brevity) extend from the respective facets 9. Each tooth 5 tapers in a direction away from the respective facet 9, and each such tooth has a flat top land 5*a* which is remote from the respective facet.

As mentioned above, the teeth 5 fill only a portion of the gap 2 so that the remaining portion (or at least a substantial part of such remaining portion) of the gap 2 can be filled with a suitable sealing compound 6 (see FIG. 2), e.g., a compound which consists of or contains butyl rubber.

Each section of the connector 1 is provided with two preferably identical recesses 7 which are spaced apart from one another, as considered in the longitudinal direction of the connector, and are disposed at the opposite sides of the two teeth 5, i.e., these teeth are located substantially midway between the two inner recesses 7 of the connector 1. The material of the tubular components 3 is deformable, at least in the region of those walls (8) which are adjacent to the recesses 7, so that portions of the walls 8 can be depressed into the adjacent recesses 7 in order to prevent extraction of the connector 1. The extent of deformation of the walls 8 is preferably such that their depressed portions completely or practically completely fill the adjacent recesses 7.

The mode of assembling the connector 1 with the tubular components 3 is preferably such that portions of the teeth 5 penetrate into the adjoining end faces 4 of the deformable components 3 in order to reduce the width of the gap 2 as well as to reduce the likelihood of angular movement of the components 3 relative to each other in response to torsional or analogous stresses. As mentioned above, the teeth 5 do not extend outwardly beyond the external surfaces of the adjacent end portions of the tubular components 3 so that they can bite into the end faces 4 and reliably hold the components 3 against angular movement relative to each other. At the same time, the depressed portions of the walls 8 cooperate with the surfaces bounding the recesses 7 to hold the tubular components 3 against axial movement relative to each other, i.e., the width of the gap 2 remains unchanged. Thus, once the gap 2 is adequately filled with a satisfactory sealing compound 6, the interior of the multiple-pane window (space A) is airtightly sealed from the surrounding area B, at least in the region of the gap 2.

For example, the distance between the top land 5*a* of a tooth 5 and the respective facet 9 may be in the range of slightly more than 0.5 millimeter. The utilization of outwardly tapering teeth 5 with flattened top lands 5*a* contributes to more reliable compensation for manufacturing tolerances, not only as concerns the making of teeth 5 and of the adjacent part of the connector 1 but also as concerns the making of end portions of the tubular components 3 in the region of the corresponding end faces 4. Since the top lands 5*a* are disposed inwardly of the external surfaces of the respective end portions of the tubular components 3, the teeth 5 penetrate primarily into the inner portions of the end faces 4 so that the outer part of the gap 2 is narrower than the inner part but is still wide enough to allow for introduction of a requisite quantity of suitable sealing compound (note FIG. 2).

FIG. 1 shows that the outer side of the prefabricated connector 1 is coated with layers of sealing compound 6, at least in the regions at both sides of the teeth 5. In the illustrated embodiment, the two coherent layers of sealing compound 6 extend to and also cover the surfaces bounding the two inner recesses 7. The layers of sealing compound 6 at the outer side of the connector 1 are nearest to the edge faces of the panes in the fully assembled multiple-pane window. The material of the layers which coat portions of the outer side of the connector 1 may be the same as the mass of sealing compound 6 which is used to fill that portion of the gap 2 which is not filled by the teeth 5. As mentioned above, such sealing compound may consist of or may contain butyl rubber or a similar tough but elastic mass. Portions of the layers of sealing compound 6 also cover the teeth 5.

FIG. 3 shows that the central zone 11 of the outer side of the connector 1, namely the zone from which the teeth 5 extend, is somewhat recessed to constitute a shallow depression, and the connector 1 has a distancing element 10 in the form of a longitudinally extending ridge or rib which is disposed midway between the teeth 5 and extends longitudinally beyond both sides of each tooth. As can be seen in FIG. 1, the length of the distancing element 10 is several times the width of a tooth 5, as considered in the longitudinal direction of the connector 1. The recessed zone or depression 11 is preferably filled with sealing compound 6. The distancing element 10 has a preferably flat exposed top face 10*a*, and such top face 10*a* is located inwardly (i.e., at a level below, as viewed in FIG. 3) of the major part of the outer side of the connector 1. The design of the distancing element 10 is preferably such that the distance between its top face 10*a* and the outermost part of the external surface of the connector 1 is half the distance between such outermost part and the bottom surface in the depression 11. For example, the depth of the depression 11 can be in the range of approximately 0.5 millimeter, and the distance between the top face 10*a* and the surface at the bottom of the depression 11 can be 0.2–0.3 millimeter. When the spacer is assembled, the distancing element 10 extends across the gap 2 into each of the two tubular components 3. As mentioned above, the distancing element 10 is or can be disposed midway between the two teeth 5.

Proper configuration and inclination of surfaces bounding the recesses 7 in the connector 1 also contributes to more satisfactory sealing action in the region of the gap 2. As can be seen in FIGS. 1 and 3, those portions of the recesses 7 which are remotest from the teeth 5 are bounded by relatively narrow end surfaces 12 which slope inwardly from the external surface of the connector 1 and toward the teeth 5, and the recesses 7 are further bounded by pairs of mutually inclined side surfaces 13 which taper inwardly toward the longitudinal central symmetry plane of the connector 1. The slope of each surface 12 is preferably pronounced. The width of each recess 7 increases gradually in a direction toward the center of the connector 1, i.e., toward the teeth 5, and the depth of each recess 7 decreases in the same direction. While FIG. 1 shows that the layers of sealing compound 6 cover only the surfaces of those two recesses 7 which are nearer to the teeth 5, it is equally possible and often desirable to provide longer layers of sealing compound so that they also cover portions of or the entire surfaces bounding the two outer recesses 7.

The mode of assembling the connector 1 with the tubular components 3 of the spacer is as follows:

The layers of sealing compound 6 cover the outer side of the connector 1 before the latter is inserted into the tubular components 3 to the extent which is permitted by the teeth 5. At such time, the walls 8 of the components 3 are still undeformed so that each of the two sections or halves of the connector 1 can be readily introduced into the respective tubular component. When the end faces 4 of the tubular components 3 abut against the respective sides of the two teeth 5, the walls 8 of the components 3 are deformed so that they follow the outlines of surfaces (including the surfaces 12, 13) in the respective recesses 7 whereby such deformation of the walls 8 entails the generation of forces which urge the tubular components 3 toward each other and cause partial penetration of teeth 5 into the adjacent inner portions of the end faces 4. The deforming action is preferably applied to the walls 8 in such a way that the material of the walls 8 is forced against the inclined outer or end surfaces 12 in the adjacent recesses 7. Such mode of deforming the walls 8 results in forcible migration of sealing compound 6, which forms the layers at the outer side of the connector 1, toward the gap 2 between the end faces 4 of the tubular components 3. As mentioned above, partial penetration of teeth 5 into the adjacent inner portions of both end faces 4 is desirable and advantageous because the teeth 5 then hold the components 3 against angular movement relative to each other. This reduces the likelihood of the establishment of gaps between the spacer and the adjacent surfaces of the panes.

In the next step, additional portions 14 of the walls 8 are deformed in the regions outwardly of the depression 11 in the outer side of the connector 1 so that the depressed portions 14 of the walls 8 displace at least some of the sealing compound 6 which was introduced into the depression 11 prior to insertion of the two sections of the connector 1 into the tubular components 3. It will be noted that the end portions 14 of the walls 8 (immediately adjacent to the respective end faces 4) are forced into the depression 11 at both sides of the two teeth 5. The purpose of the distancing element 10 is to limit the extent of depression of the wall portions 14 and hence the extent of expulsion of sealing compound 6 from the depression 11.

It has been found that the just described mode of coupling the connector 1 with the deformable tubular components 3 of the spacer ensures the establishment of a form-locking engagement between the connector on the one hand and the tubular components on the other hand as well as the establishment of a seal which reliably prevents the flow of air between the spaces A and B. Depression of portions of the walls 8 into the recesses 7 holds the parts 1, 3, 3 against axial movement relative to each other; penetration of portions of the teeth 5 into the end faces 4 of the tubular components 3 prevents angular movements of such components relative to one another; penetration of portions of the walls 8 into the recesses 7 entails at least some flow of sealing compound 6 toward the teeth 5; and the making of depressed wall portions 14 adjacent to the depression 11 (and to the extent which is determined by the distancing element 10) ensures highly desirable distribution of sealing compound in the region of and immediately adjacent to the gap 2 with attendant desirable and long-lasting sealing action.

It was further ascertained that the just discussed mode of coupling the connector 1 with the tubular components 3 ensures the establishment of a reliable airtight seal and the absence of excessive twisting and/or other movements of the components 3 relative to each other even if the temperature in the area or space B fluctuates within a wide range so that the entire spacer is subject to at least some expansion or contraction as a result of pronounced temperature changes.

It will be seen that, in contrast to the heretofore prevailing practice, the abutment or protuberance including the teeth 5 is designed in such a way that it prevents complete closing of the gap 2. This provides room for introduction of requisite quantities of a suitable sealing compound into that (remaining) portion of the gap 2 which is not filled by the teeth 5. The volume of such remaining portion of the gap 2 suffices to allow for convenient introduction of a very tough (highly viscous) compound which is best suited to establish a long-lasting airtight seal.

The aforediscussed configuration of the recesses 7 and the aforediscussed mode of depressing the adjacent portions of the walls 8 into such recesses also contributes to more reliable sealing of the joint between the connector 1 and the two tubular components 3. Depression of portions of the walls 8 into the recesses 7 prior to deformation of the wall portions 14 so that the latter penetrate into the depression 11 to the extent which is determined by the height of the distancing element 10 also contributes to the establishment of a more reliable seal. Thus, those portions of the walls 8 which extend into the respective recesses 7 ensure that the connector 1 and the tubular components 3 are held against axial movement relative to each other during the next stage of completion of the spacer, namely during shifting of the wall portions 14 into the respective portions of the depression 11.

The application of layers of sealing compound 6 to the outer side of the external surface of the connector 1 at both sides of the teeth 5 in a manufacturing plant, rather than at the locale of assembly of the spacer, also contributes to the making of a more reliable seal because the distribution and thickness of such layers are not dependent upon the skill and/or care of the attendants but can be effected by suitable machines which invariably apply optimum quantities of sealing compound in optimum distribution to short or long series of successive connectors. Deformation of the end portions 14 of walls 8 which form part of the tubular components 3 is carried out in such a way that the sealing compound which is expelled from the depression 11 flows toward and into the gap 2 and can fill that portion of the gap which is not filled by the teeth 5, i.e., the gap 2 can be completely or adequately filled with suitable sealing compound as a result of appropriate deformation of the walls 8, first to fill the recesses 7 and thereupon to expel a predetermined quantity of sealing compound from the depression 11. While it is possible and, under certain circumstances, advisable to introduce a certain quantity of sealing compound into the gap 2 subsequent to deformation of the end portions 14 of the walls 8, this is not always necessary, especially if the spacer is assembled in an automatic machine wherein the extent of shifting of the material of the walls 8 into the depression 11 can be regulated with a high degree of precision so as to ensure complete or adequate filling of the gap 2 with sealing compound from the inside, i.e., with sealing compound which is expelled from the depression 11 as a result of deformation of the end portions 14 of the walls 8. Such predictable and preferably automatic filling of the gap 2 (at least at the outer side of the connector 1) with a suitable sealing compound renders it possible to dispense with the aforediscussed groove around the assembled spacer so that the tubular components of the spacer can be placed into immediate or close proximity of the edge faces of the panes, i.e., the area A is increased to a maximum possible extent so as to ensure that the spacer can be concealed in a relatively narrow groove of the frame which receives the marginal portions of the fully assembled multiple-pane window.

The placing of the teeth 5 substantially or exactly in the middle between the end portions 1*a* is desirable and advantageous because this ensures that each of the two tubular components 3 receives a section whose length matches half the overall length of the connector 1. If the layers of sealing compound 6 are applied equally to both sections of the connector 1, and if the extent to which the walls 8 are depressed into the recesses 7 as well as into the depression 11 is the same, the sealing, centering, torsion-preventing, axial fixing and bonding action between the connector 1 and one of the tubular components 3 is the same as that between the connector and the other tubular component. Moreover, such design of the connector 1 is most likely to ensure predictable flow of sealing compound toward and into the gap 2 so that the sealing action at one side of the teeth 5 is just as satisfactory as the sealing action at the other side of these teeth. Such mirror symmetrical displacement and distribution of sealing compound (with reference to a plane including the teeth 5) has been found to contribute significantly to reliability of the seal at the gap 2 as well as to reliability of the connection between the member 1 and the tubular components 3.

The height of the distancing element 10 can be readily selected in such a way that it allows for expulsion of optimum quantities of sealing compound from the outer region of the depression 11 toward and into the gap 2 when the end portions 14 of the walls 8 are deformed subsequent to deformation of those wall portions which enter the recesses 7. The placing of the distancing element 10 substantially centrally between the teeth 5 so that one-half of the distancing element extends into one tubular component 3 and the other half extends into the other tubular component 3 also contributes to predictable flow of requisite quantities of sealing compound from the depression 11 into the gap 2 in response to inward flexing of the end portions 14 of the walls 8. The sealing compound which remains in the depression 11 ensures the establishment of satisfactory seals between the deformed end portions 14 of the walls 8 and the adjacent portions of the connector 1 in regions immediately adjacent to and flanking the gap 2.

The provision of relatively steep end surfaces 12 which slope inwardly from the external surface of the connector 1 and toward the teeth 5 ensures that, when the walls 8 are deformed to bear against the surfaces 12, there develop two forces having components tending to shift the respective tubular components 3 in a direction toward the gap 2, i.e., in a direction to cause partial penetration of teeth 5 into the inner portions of both end faces 4. As a rule, the material of the tubular components 3 is an aluminum alloy which is sufficiently ductile to ensure adequate deformation of the walls 8 in the regions of the recesses 7 and in the region of the depression 11 as well as at least some penetration of the teeth 5 into the end faces 4 of both tubular components. The feature that portions of the walls 8 are depressed into the recesses 7 as well as in the region of the depression 11 is desirable and advantageous on the additional ground that this compensates for eventual manufacturing tolerances, not only as concerns the connector 1 but also as concerns the two tubular components 3. Moreover, such deformation of the walls 8 contributes significantly to reliability of the connection between the part 1 and the tubular components 3, not only as regards the resistance to torsional stresses but also as concerns the resistance to stresses which would tend to widen or narrow the gap 2. As mentioned above, the improved spacer has been found to be capable of withstanding very pronounced stresses which develop when the multiple-pane window is in actual use, especially those stresses which are attributable to thermally induced expansion or contraction of various constituents of the spacer. It is well known that a multiple-pane window is likely to be subjected to the action of temperatures which vary within an extremely wide range, e.g., when the window is used in a house or in another building in climates where the summer temperatures deviate considerably from winter temperatures.

As mentioned above, and as can be seen in FIG. 3, the end portions 1*a* of the elongated connector 1 are preferably rounded in order to facilitate their introduction into the respective tubular components 3. The same or a similar result can be achieved if the end portions of the connector 1 are bevelled, provided with conical surfaces, imparted the shape of pointed or truncated pyramids or configurated in any other way which allows for convenient introduction of the end portions of the connector into the respective tubular components of the spacer.

In order to reduce the overall weight of the connector 1, its inner side 1*b* can be formed with one or more cutouts or cavities (one indicated by broken lines, as at 1*c*, in FIG. 2) as long as the provision of such cutout or cutouts does not unduly reduce the ability of the connector to stand bending, twisting and/or other stresses which can arise during assembly or as a result of thermally induced expansion or contraction of the finished spacer.

The layers of sealing compound 6 at the outer sides of the connector 1 at both sides of the two teeth 5 can be covered by a sheet 15 of metallic or plastic foil (indicated in FIG. 1 by phantom lines) in order to allow for stacking of a plurality of prefabricated connectors one next to or on top of the other. The prefabricating operation preferably involves the application of layers of sealing compound to the connectors 1 at the locus of manufacture rather than at the locus of use. The sheet 15 ensures that the layers of sealing compound which are applied to neighboring connectors 1 do not adhere to each other. It will be readily appreciated that the material of the sheet 15 will be selected with a view to facilitate ready separation from the layers of sealing compound 6 on the respective connector 1. The sheet 15 further prevents contact between the sealing compound 6 at both sides of the teeth 5 and any other objects, i.e., not necessarily with the sealing compound on an adjacent connector. The sheet 15 can be much larger than that which is shown in FIG. 1 so that it can simultaneously overlie the layers of sealing compound on two, three or a much larger number of neighboring connectors 1. For example, an entire row of connectors 1 (each carrying a layer of sealing compound 6) can be placed parallel next to each other and a single sheet 15 is then placed over the layers on such connectors to ensure that the layers remain intact and do not cause the respective connectors to adhere to other objects. The thus arrayed connectors can be converted into a roll for storage in a small area. It is also possible to roll discrete sheets 15 around discrete connectors 1; this ensures that the sheets 15 also cover the sealing compound which overlies portions of the facets 9 so as to even further reduce the likelihood of undesirable coherence between two neighboring connectors. However, such rolling of sheets 15 around individual connectors is not absolutely necessary because the neighboring connectors can be readily separated from each other even if they are bonded to one another by some of the sealing compound in the region of their inclined longitudinally extending lateral facets 9. The separating operation can be carried out in suitable machines or even by hand. Separation in suitable machines will be preferred if the assembly of connectors 1 with tubular components 3 takes place in automatic or semiautomatic apparatus.

The provision of one or more sheets 15 is particularly desirable when a substantial number of prefabricated and coated connectors 1 are placed into the hopper of a machine for automatic or semiautomatic assembly of spacers. The sheet or sheets 15 prevent adherence of neighboring connectors 1 to each other, at least in those regions where such adherence could adversely influence the thickness and/or distribution of adhesive sealing compound 6 which forms the layers that are to bond the sections of the connectors 1 to the respective pairs of tubular components 3 as well as to furnish material for the establishment of airtight seals in the regions of the respective gaps 2.

An important advantage of the improved spacer and its connector is that the sealing action in the region of the gap 2 is highly satisfactory in spite of the fact that the teeth 5 are designed not to allow for complete sealing of the gap 2. The establishment of a gap 2, which is not fully closed even after the teeth 5 have been caused to partially penetrate into the adjacent end faces 4 radially inwardly of the external surfaces of the end portions of the respective tubular components 3, renders it possible to fill the remainder of the gap 2 with a suitable sealing compound 6 and to thus enhance the reliability of the seal in the region of the gap. The feature that the teeth 5 penetrate into the inner portions of the end faces 4 is desirable and advantageous on the additional ground that the width of the gap 2 is reduced at the inner side of the spacer, namely, at the side which faces the space A and is observable by looking through the one or the other window pane. In fact, by properly filling the remainder of the gap 2 with a sealing compound, one can completely conceal the gap 2 so that it does not detract from the appearance of the multiple-pane window. The spacer between the panes of a window can comprise two or more connectors 1, depending on the number of tubular components 3. The illustrated tubular components 3 can constitute the two end portions of a single elongated tubular body so that the spacer then requires only a single connector.

The improved spacer and its connector are susceptible of many additional modifications without departing from the spirit of the invention. For example, the recesses 7 can be provided at the inner side of the connector 1 (i.e., at the side facing the space A) or one or more recesses can be provided at each side of the connector. Moreover, one or more recesses (two shown at 16) can be provided in the lateral facets 9 in addition to or in lieu of the illustrated and described recesses 7. The number and distribution of recesses will depend on a number of factors, such as the desired resistance which the connector 1 and the tubular components 3 should offer to separation from one another. One or more recesses 17 can be provided in the side surfaces 1*d* of the connector 1 (see FIG. 1) in addition to or instead of the aforediscussed recesses 7 and 16. The overall number of recesses 7, 16 and/or 17 can be varied within a wide range, depending on their dimensions, the desired retaining action, the ductility of the material of the tubular components 3 and/or other parameters. The cutout or cutouts 1*c* can also constitute one or more recesses. The connector 1 can be made of any suitable (metallic or plastic) material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a spacer for the panes of a multiple-pane window, the combination of first and second deformable tubular components having respective end portions arranged in a substantially straight line, said end portions having adjacent end faces defining a gap; an elongated connector including a substantially straight plug having first and second sections disposed in the interiors of the respective components, and a composite abutment disposed between said end faces and partially filling said gap, said abutment comprising at least two portions which are spaced from one another circumferentially of said gap, and each of said sections having at least one recess, the respective components having depressed portions extending into the respective recesses to hold the sections against extraction from the respective components; and a mass of sealing compound filling at least a portion of the remainder of said gap.

2. The combination of claim 1, wherein said abutment constitutes a protuberance which is at least partially recessed into the end faces of said deformable tubular components.

3. The combination of claim 1, wherein said plug has a pair of longitudinally extending first and second lateral facets and said portions of said abutment each extends from a respective facet.

4. The combination of claim 1, wherein said plug has an external surface and said portions of said abutment extend beyond and taper in directions away from said external surface.

5. The combination of claim 4, wherein each portion of said abutment has a top land remote from said external surface.

6. The combination of claim 1, further comprising layers of sealing compound interposed between said sections and the respective components.

7. The combination of claim 6, wherein said sealing compound contains butyl rubber.

8. The combination of claim 6, wherein said abutment is located at least substantially midway between the ends of said plug.

9. The combination of claim 6, wherein said layers are adjacent to said abutment.

10. The combination of claim 1, wherein said connector has an outer side and said abutment portions of said extend from said outer side, said connector further having a depression between said portions of said abutment and a distancing element disposed in or close to the central region of said depression.

11. The combination of claim 10, wherein said distancing element has a top face disposed inwardly of the outer side of said connector and said components include depressed portions abutting against said top face.

12. The combination of claim 11, wherein the depth of said depression is approximately twice the height of said distancing element.

13. The combination of claim 10, wherein said distancing element is elongated and includes first and second portions within the confines of the respective tubular components.

14. The combination of claim 10, wherein said distancing element is disposed substantially midway between said portions of said abutment.

15. The combination of claim 1, wherein said connector has an external surface and each of said recesses is bounded in part by an end surface sloping inwardly from said external surface and toward said abutment.

16. The combination of claim 1, wherein each of said recesses widens in a direction toward said abutment.

17. The combination of claim 16, wherein the depth of each of said recesses decreases in a direction toward said abutment.

18. The combination of claim 1, wherein each section of said connector has two recesses.

19. The combination of claim 1, further comprising a layer of sealing compound covering at least a portion of each of said sections including the surfaces bounding the recesses in said sections.

20. The combination of claim 1, wherein said connector has an external surface including an outer side from which said abutment extends and an inner side having at least one cutout therein.

21. The combination of claim 1, wherein said connector has at least substantially rounded end portions.

22. The combination of claim 1, wherein said connector has an outer side and at least one of said recesses is provided in said outer side.

23. The combination of claim 1, wherein said connector has an inner side and at least one of said recesses is provided in said inner side.

24. The combination of claim 1, wherein said connector has two side surfaces and at least one of said recesses is provided in one of said side surfaces.

25. As a novel article of manufacture for use as a connector for tubular components of a spacer between the panes of a multiple-pane window, an elongated, substantially straight plug having a composite abutment, two elongated sections flanking said abutment, and at least one recess in each of said sections, said abutment comprising at least two protuberances which are spaced from one another circumferentially of said plug.

26. The structure of claim 25, further comprising at least one additional plug adjacent to said first named plug, said sheet overlying the layers on both plugs.

27. The structure of claim 26, wherein said plugs are parallel to each other.

28. The structure of claim 25, comprising a layer of adhesive sealing compound coating at least a portion of each of said sections:

29. The structure of claim 28, comprising a sheet of flexible protective material overlying said layers to prevent adherence of said compound to adjacent objects prior to detachment of said sheet and insertion of said sections into the tubular components of a spacer.

30. The structure of claim 25, wherein said abutment is located substantially centrally of said plug.

* * * * *